US009958807B1

(12) United States Patent
Huang

(10) Patent No.: US 9,958,807 B1
(45) Date of Patent: May 1, 2018

(54) TONER CARTRIDGE

(71) Applicant: GENERAL PLASTIC INDUSTRIAL CO., LTD., Taichung (TW)

(72) Inventor: Ching-Ho Huang, Taichung (TW)

(73) Assignee: General Plastic Industrial Co., Ltd., Taichung (TW)

( * ) Notice: Subject to any disclaimer, the term of this patent is extended or adjusted under 35 U.S.C. 154(b) by 0 days. days.

(21) Appl. No.: 15/585,350

(22) Filed: May 3, 2017

(51) Int. Cl.
*G03G 15/08* (2006.01)

(52) U.S. Cl.
CPC ..... *G03G 15/0867* (2013.01); *G03G 15/087* (2013.01); *G03G 15/0836* (2013.01)

(58) Field of Classification Search
CPC ..... G03G 15/0867; G03G 15/0836; G03G 15/087
See application file for complete search history.

(56) References Cited

U.S. PATENT DOCUMENTS 6,091,919 A * 7/2000 Nozawa ..... G03G 15/0872 222/DIG. 1
2008/0298837 A1* 12/2008 Mase ..... G03G 21/1839 399/119
2008/0317511 A1* 12/2008 Mase ..... G03G 15/0894 399/262
2013/0216272 A1* 8/2013 Koshimori ..... G03G 15/0886 399/262

* cited by examiner

*Primary Examiner* — Rodney Bonnette
(74) *Attorney, Agent, or Firm* — Muncy, Geissler, Olds & Lowe, P.C.

(57) ABSTRACT

A toner cartridge comprises a tubular body, a sliding base, a swinging member and a returning member. A first end of the tubular body provides with an arc-shape rail and an imaginary axis. The sliding base is slidable along the rail. The swinging member includes a pivotal portion pivotally connected with the sliding base, an inner end portion, and an outer end portion that is farther from the imaginary axis than the pivotal portion is. The swinging member is swingable between an inward position and an outward position relative to the sliding base. The returning member is connected with the swinging member and applies a force returning the swinging member to the inward position. Accordingly, the toner cartridge can be rotated into positioned actually, so as to engage with an electronic image forming apparatus successfully, and a lock mechanism of the electronic image forming apparatus can be released actually.

17 Claims, 12 Drawing Sheets

TONER CARTRIDGE

BACKGROUND OF THE INVENTION

1. Field of the Invention

The present invention relates generally to electronic image forming apparatus and more particularly, to a toner cartridge used for the electronic image forming apparatus.

2. Description of the Related Art

A laser printer, an inkjet printer or other electronic image forming apparatus becomes one of necessary equipment of office because people often copy document on working. The electronic image forming apparatus is composed of multiple components, and toner cartridge is one of important components of the electronic image forming apparatus for achieving the copy function. A conventional toner cartridge is usually detachable, so that it is convenient for user to change or supply toner. In usual, a user may need to rotate the toner cartridge into positioned after the cartridge inserts into the electronic image forming apparatus, then copying function can be operated successfully. However, part of toner cartridges usually cannot be positioned actually, so that chip pins on the toner cartridge do not contact with the corresponding pins on the electronic image forming apparatus, a transmitting assembly of the toner cartridge do not connect to a driving member of the electronic image forming apparatus, or a toner outlet of the toner cartridge is not located corresponding to a toner inlet of the electronic image forming apparatus, and other assembling issues may occur. As a result, the electronic image forming apparatus cannot drive the toner cartridge successfully. On the other hand, part of electronic image forming apparatuses may provide with a lock mechanism, the lock mechanism can block not only toner inlet thereof but also the rotation of the toner cartridge, therefore lock status of the lock mechanism need be released during assembling of the toner cartridge. However, in fact, the lock status of the lock mechanism does not be released usually, so that the assembling of the toner cartridge fails.

SUMMARY OF THE INVENTION

The present invention has been accomplished in view of the above-noted circumstances. It is an objective of the present invention to provide a toner cartridge, which can be positioned actually and engaged with the electronic image forming apparatus successfully, and the lock mechanism of the electronic image forming apparatus can be released actually.

To attain the above objective, the present invention provides a toner cartridge, which comprises a tubular body, a sliding base, a swinging member and a returning member. The tubular body includes an arc-shape rail at a first end thereof, and a geometric center through which an imaginary axis passes. The sliding base is disposed on the rail and slidable along the rail. The swinging member includes a pivotal portion pivotally connected with the sliding base, an inner end portion that is nearer to the imaginary axis than the pivotal portion is, and an outer end portion that is farther from the imaginary axis than the pivotal portion is. The swinging member is swingable between an inward position and an outward position relative to the sliding base. The returning member is connected with the swinging member and applies a force returning the swinging member to the inward position.

Accordingly, when the swinging member swings to the outward position by an external force, a lock mechanism of the electronic image forming apparatus can be released.

After the toner cartridge is rotated, the swinging member is movable relative to the rail with the sliding base and continues to apply on the lock mechanism, so that a user can rotate the toner cartridge into positioned directly.

DETAILED DESCRIPTION OF THE INVENTION

Figure 1:
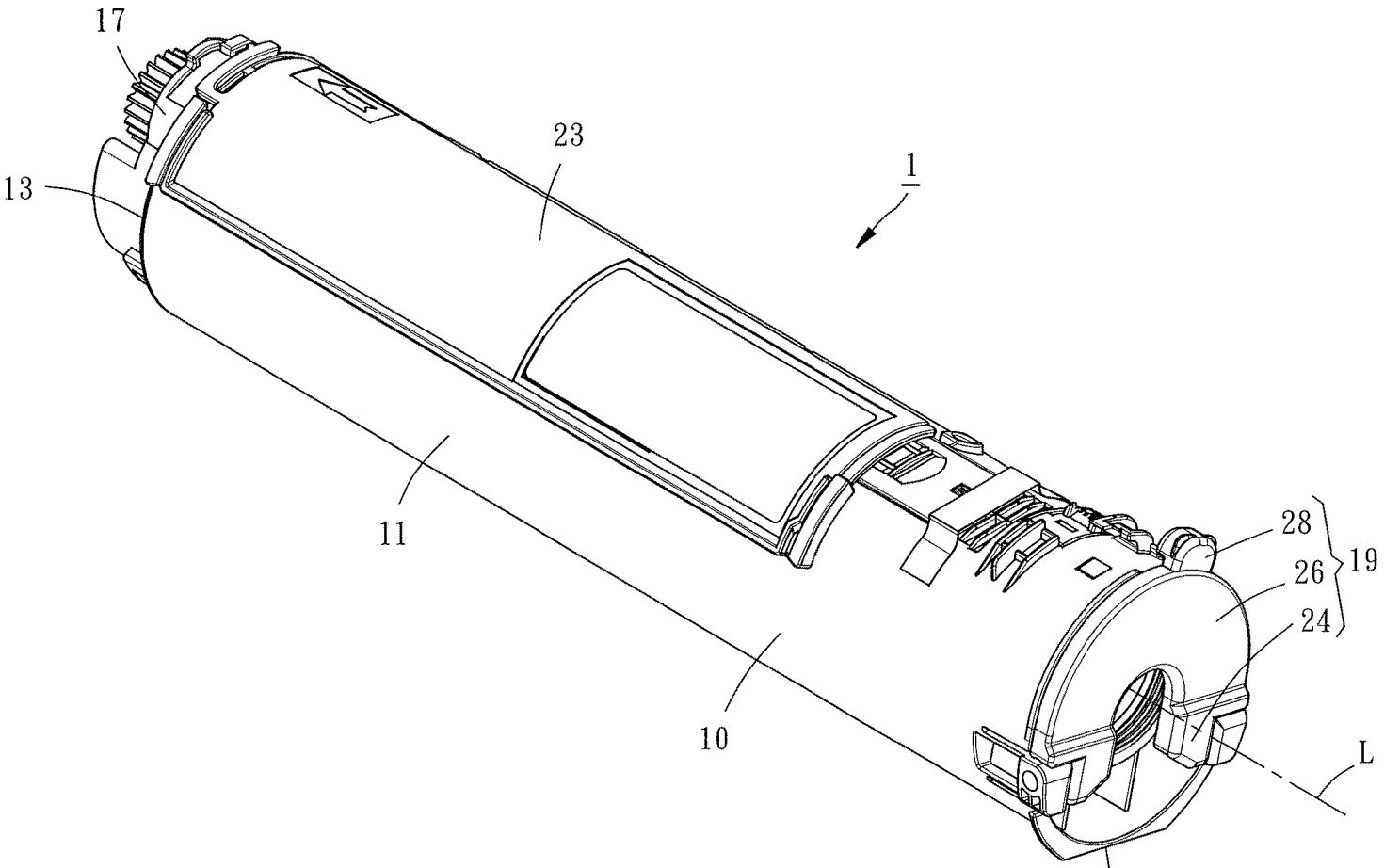
FIG. 1 is a perspective view of a toner cartridge according to a preferred embodiment of the present invention.
Figure 2:
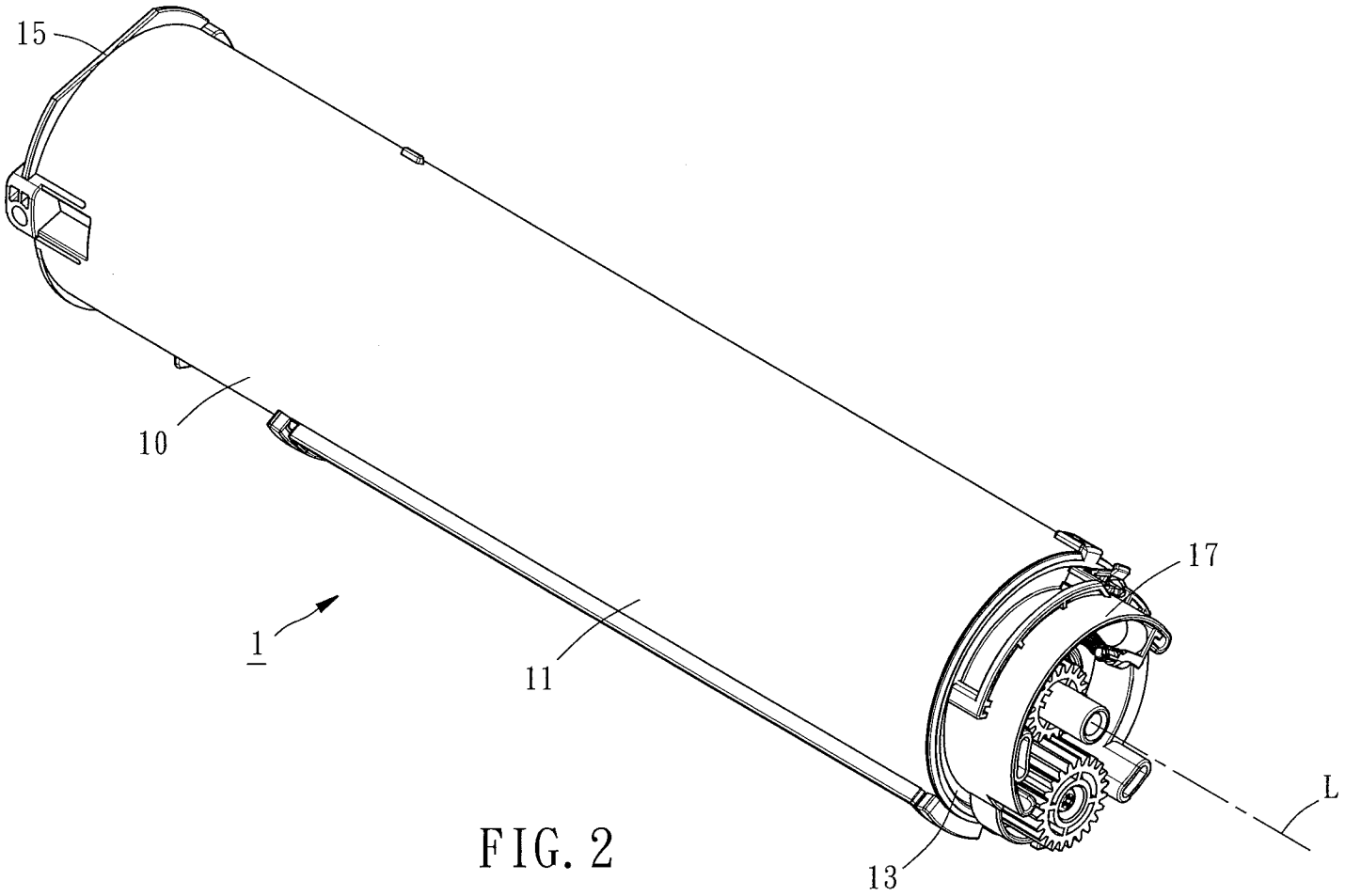
FIG. 2 is another perspective view of a toner cartridge according to the preferred embodiment of the present invention.
Figure 3:
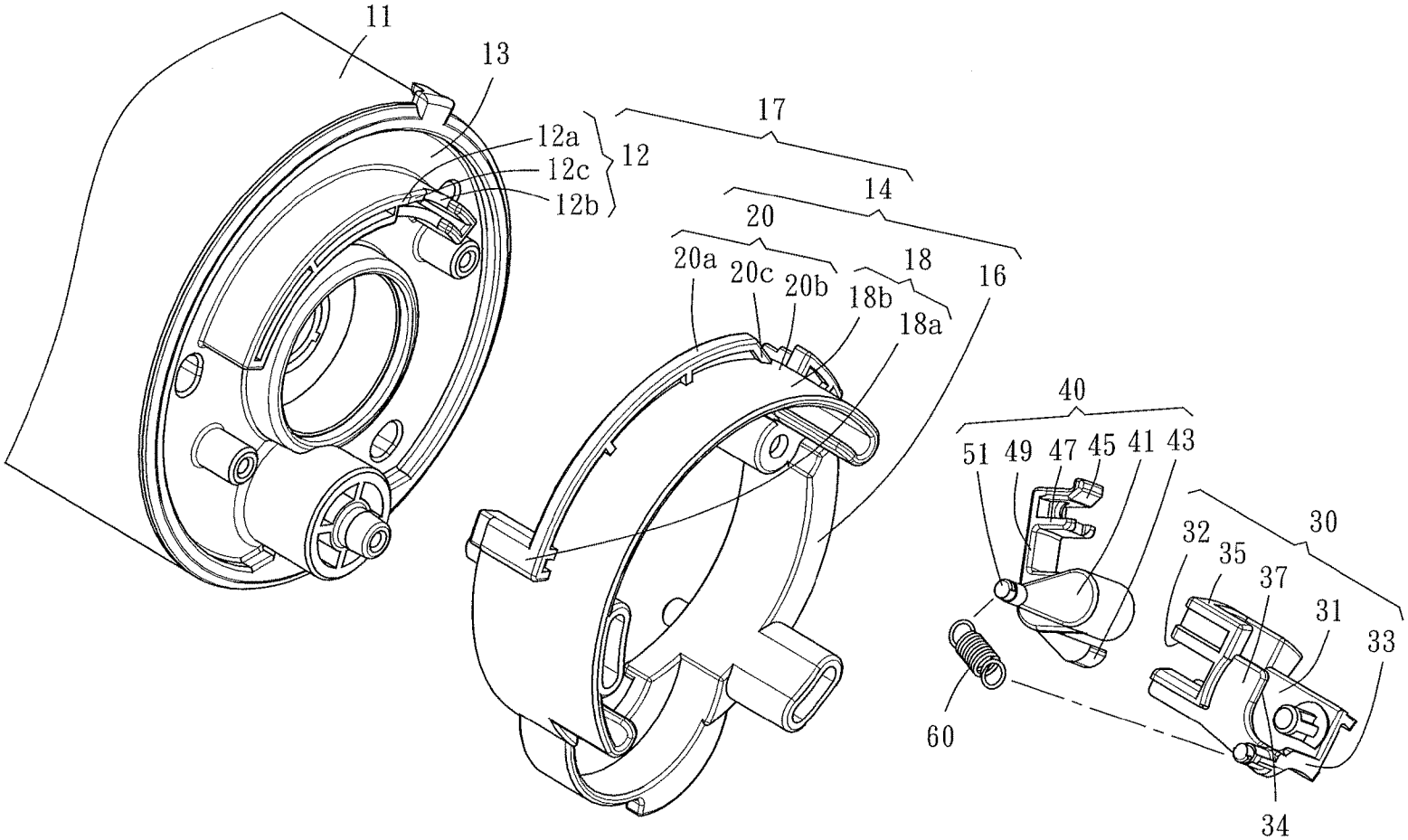
FIG. 3 is an exploded perspective view of a part of the toner cartridge according to the preferred embodiment of the present invention.

FIGS. 1-3 illustrate a toner cartridge 1 according to a preferred embodiment of the present invention. The toner cartridge 1 includes a tubular body 10, a sliding base 30, a swinging member 40 and a returning member 60.

Figure 5:
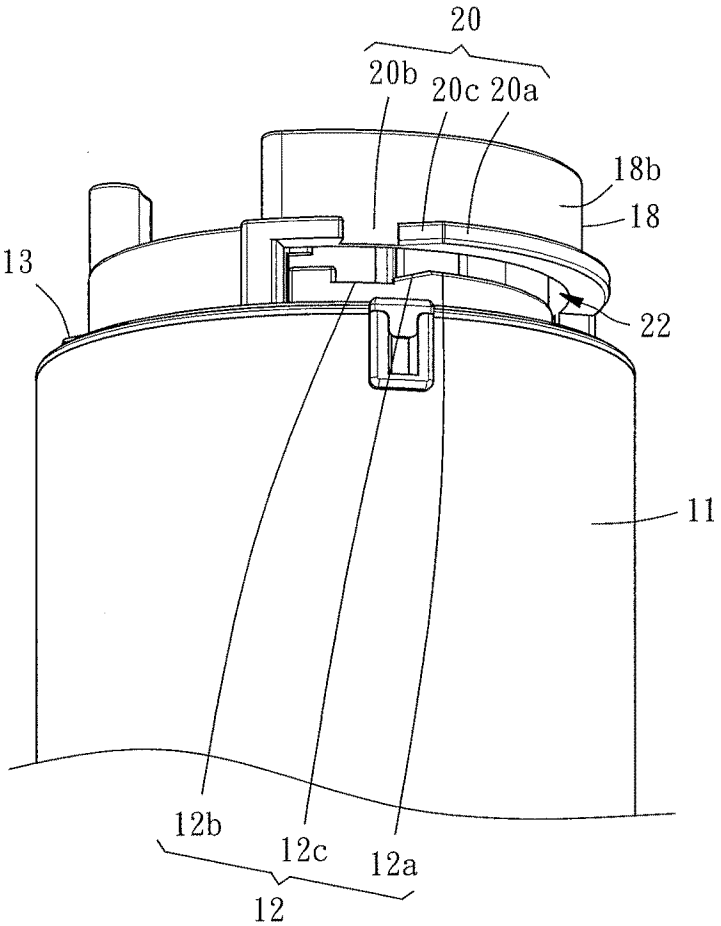
FIG. 5 is a side view of a part of the toner cartridge according to the preferred embodiment of the present invention, a sliding base and a swinging member are omitted.
Figure 16:
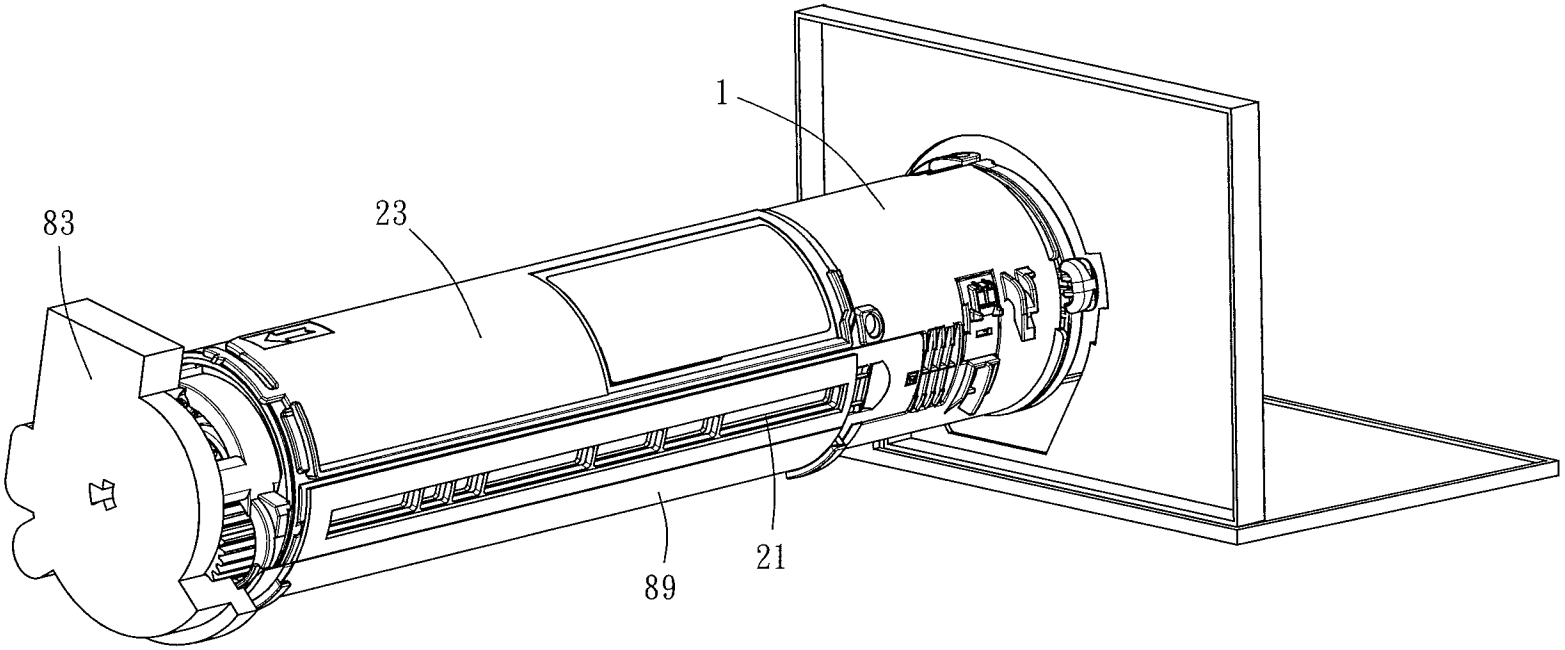
FIG. 16 is another perspective view of the toner cartridge and a part of the electronic image forming apparatus according to the preferred embodiment of the present invention.

The tubular body 10 includes a tubular portion 11, a first end 13 located at an end of the tubular portion 11, a second end 15 located at the other end of the tubular portion 11, an arc-shape rail 17 disposed at the first end 13, a handle 19 disposed at the second end 15, a toner outlet 21 disposed at the tubular portion 11 (as shown in FIG. 16), and an outlet cover 23 movably disposed at the tubular portion 11. The tubular portion 11 is used to accommodate toner and provides with a geometric center through which an imaginary axis L passes. The tubular portion 11 extends along a direction of the imaginary axis L. There are lots of designs for the rail 17, in this embodiment, referring to FIG. 3, the rail 17 includes an axial protruded rib 12 extended from the first end 13, and a limiting ring 14 disposed at the first end 13. Referring to FIGS. 3 and 5, the axial protruded rib 12 includes a second protruded section 12*a*, a second hollow section 12*b* located at an end of the second protruded section 12*a*, a second inclinedly guiding section 12*c* located between the second protruded section 12*a* and the second hollow section 12*b*. The limiting ring 14 includes a connecting portion 16, a bridge portion 18 disposed at two ends of the connecting portion 16, and a radially protruded fringe 20 disposed at the bridge portion 18. The bridge portion 18 has two connecting panels 18*a*, and an arc-shape extending panel 18*b* extended axially from top sides of the two connecting panels 18*a* respectively and extended oppositely along the circumference of the tubular portion 11 to connect together. The extending panel 18*b* is located approximately corresponding to the axially protruded lib 12. As a view from FIGS. 4-5, a distance from the first end 13 to a bottom side of the extending panel 18*b* is greater than a distance from the first end 13 to a top side of the axial protruded rib 12, so that a gap 22 exists between the bridge portion 18 and the axial protruded rib 12. The radially protruded fringe 20 includes a first protruded section 20*a*, a first hollow section 20*b* located at an end of the first protruded section 20*a*, and a first inclinedly guiding section 20*c* located between the first protruded section 20*a* and the first hollow section 20*b*. Referring to FIG. 1, the handle 19 has two pivotal portions 24 pivotally connected with a second end 15 of the tubular body 10, a hand-hold portion 26 connected with the two pivotal portions 24, and a positioning block 28 protrudedly disposed at an outer periphery of the hand-hold portion 26. Distances from the positioning block 28 to the two pivotal portions are not equal. Referring to FIG. 1, the outlet cover 23 can block the toner outlet 21, to prevent toner in the tubular portion 11 from passing through the toner outlet 21.

Figure 4:
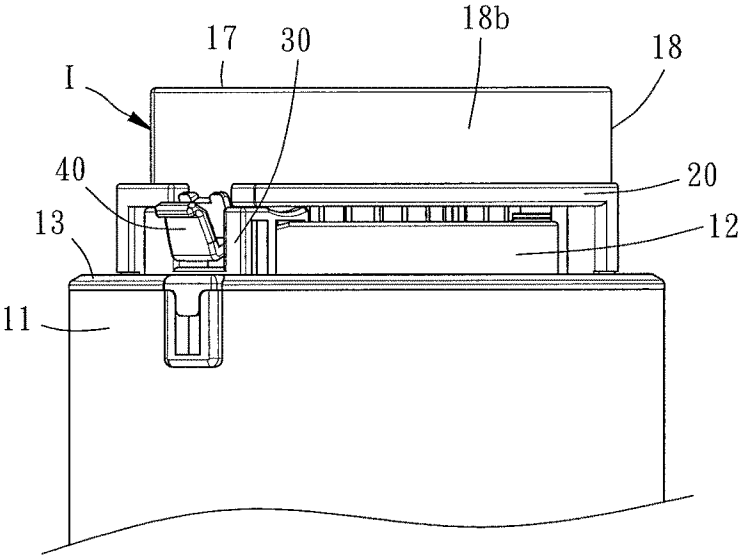
FIG. 4 is a side view of a part of the toner cartridge according to the preferred embodiment of the present invention.
Figure 10:
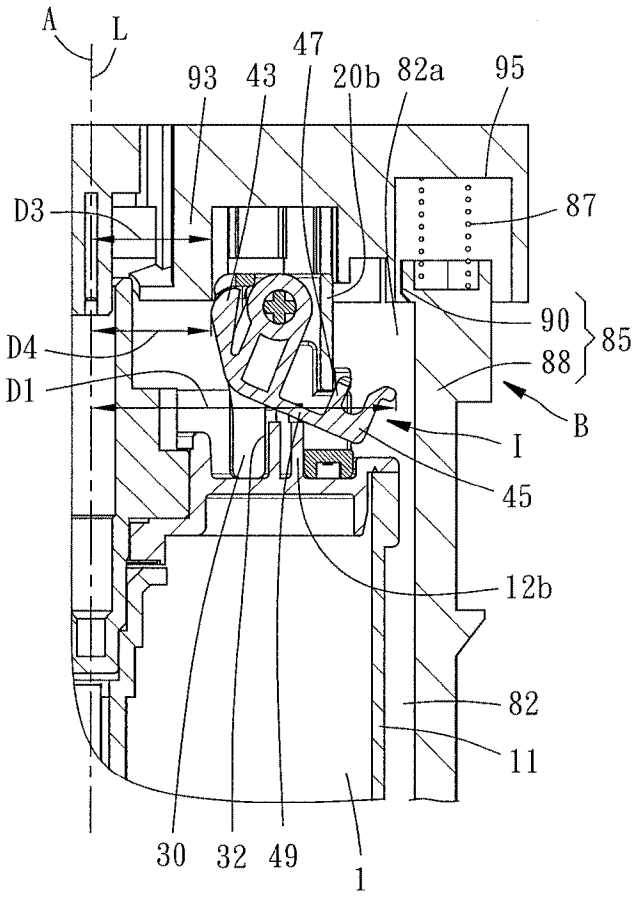
FIGS. 9-14 are functions of the toner cartridge according to the preferred embodiment of the present invention.
Figure 9:
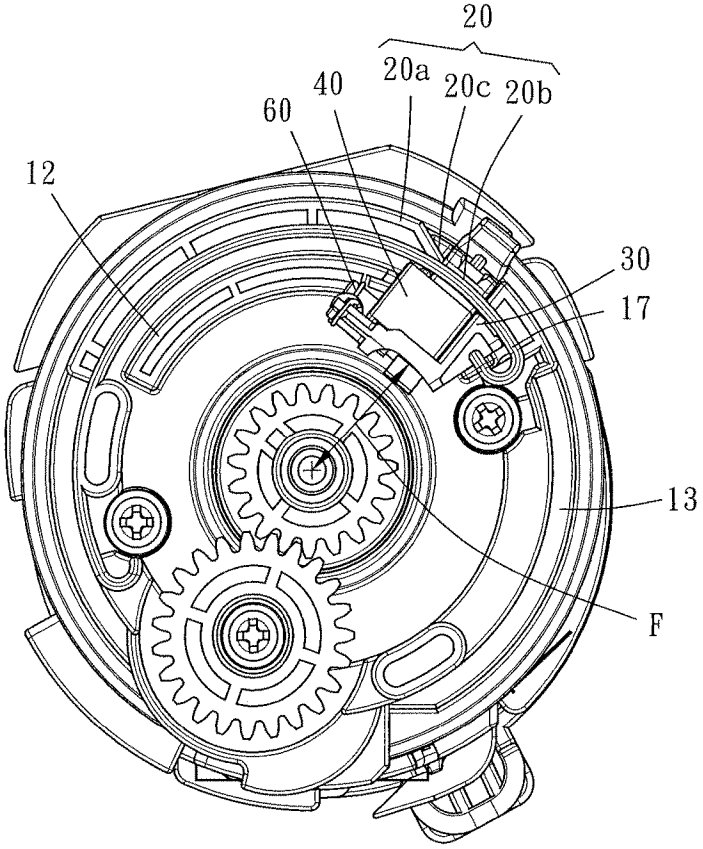
Figure 14:
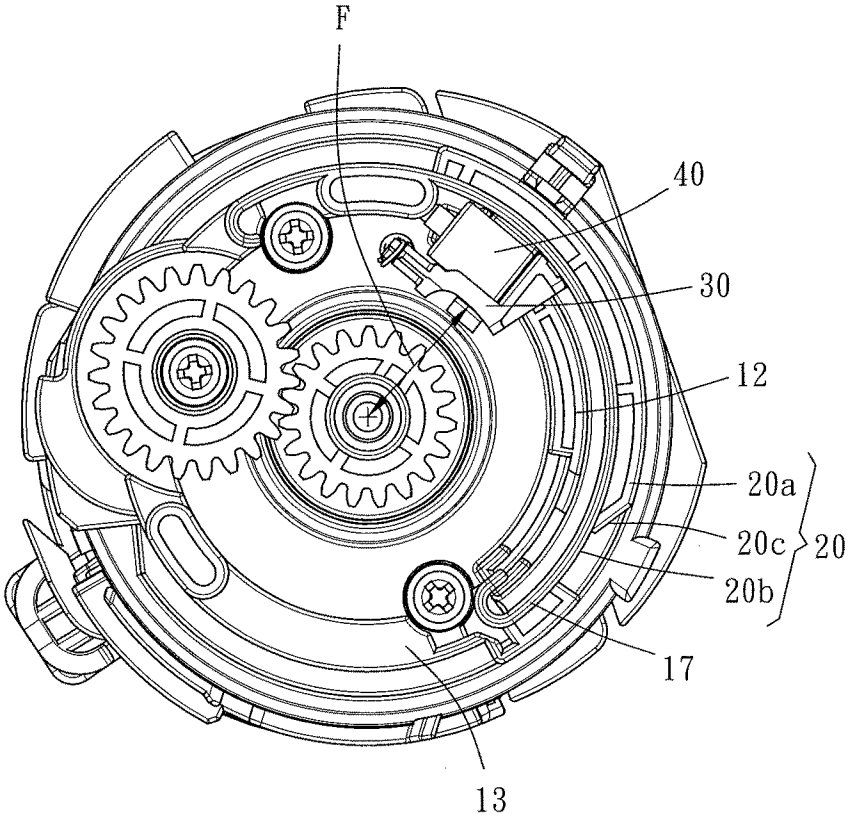

Referring to FIGS. 3 and 4, the sliding base 30 is disposed on the rail 17 and slidable along the rail 17. There are lots of designs for the sliding base 30, in this embodiment, the sliding base 30 includes a first wall portion 31, an upper connecting portion 33 connected with a top side of the first wall portion 31, a lower connecting portion 35 connected with a bottom side of the first wall portion 31, and a second wall portion 37 connected with the upper and lower connecting portions 33, 35. Bottoms of the first and second wall portions 31, 37 provide with a sliding notch 32 into which the axial protruded rib 12 inserts (as shown in FIG. 10), so that the sliding base 30 is limited by the axial protruded rib 12 in radial direction, and the sliding base 30 keeps a fixed distance F from the imaginary axis L during sliding along the rail 17 (as shown in FIGS. 9 and 14). In addition, the first and second wall portions 31, 37 and the upper and lower connecting portions 33, 35 combinedly form a swinging notch 34 (as shown in FIG. 3).

Figure 12:
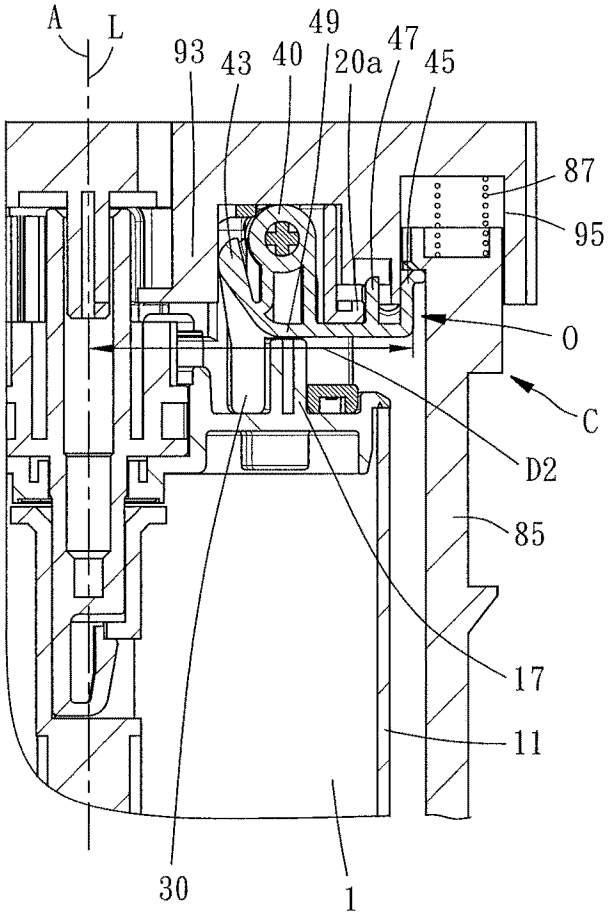
Figure 13:
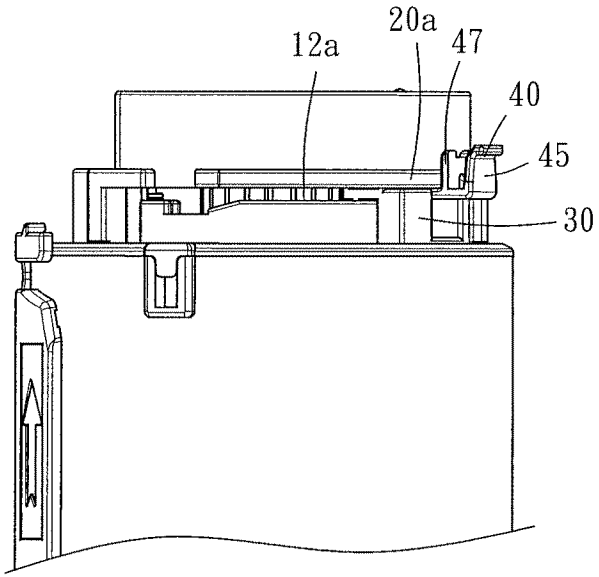

Referring to FIGS. 3 and 9, the swinging member 40 is accommodated in the swinging notch 34 of the sliding base 30, the swinging member 40 includes a pivotal portion 41 pivotally connected with the first wall portion 31 of the sliding base 30 and abutted against the second wall portion 37, an inner end portion 43 that is nearer to the imaginary axis L than the pivotal portion 41 is, an outer end portion 45 that is farther from the imaginary axis L than the pivotal portion 41 is, a first abutting portion 47 located between the pivotal portion 41 and the outer end portion 45, a second abutting portion 49 located between the pivotal portion 41 and the first abutting portion 47 and provided with part of which inserts into the sliding notch 32 of the sliding base 30 (as shown in FIG. 10), and a protruded pillar 51 disposed beside the pivotal portion 41. Referring to FIG. 4, a part of the swinging member 40 passes through the gap 22, so that the swinging member 40 is limited by the axial protruded rib 12 and the limiting ring 14 and swingable between an inward position I (as shown in FIGS. 4 and 10) and an outward position O (as shown in FIGS. 12 and 13) relative to the sliding base 30. Referring to FIGS. 9 and 10, when the swinging member 40 is located at the inward position I, the outer end portion 45 is located at a first distance D1 away from the imaginary axis L, the first abutting portion 47 abuts against the first hollow section 20*b*, and the second abutting portion 49 abuts against the second hollow section 12*b* (as shown in FIG. 10). On the other hand, referring to FIGS. 12 and 14, when the swing member 40 is located at the outward position O, the outer end portion 45 is located at a second distance D2 away from the imaginary axis L, the first and second distances D1 and D2 satisfy an inequality of D1<D2. It is assumed that the swinging member 40 moves along the rail 17 to a position as shown in FIG. 14, the first abutting portion 47 abuts against the first protruded section 20*a*, and the second abutting portion 49 abuts against the second protruded section 12*a*.

Referring to FIG. 3, two ends of the returning member 60 are connected with the protruded pillar 51 of the swinging member 40 and the second wall portion 37 of the sliding base 30. The returning member 60 applies a pre-stressed force returning the swinging member 40 to the inward position I, when the swinging member 40 is not applied by other external force, the swinging member 40 is located at the inward position I. When the swinging member 40 applies an external force outwardly, the external force can overcome the pre-stressed force of the returning member 60, so that the swinging member 40 swings toward the outward position O. In should be noticed that, the returning member 60 is an extension spring. However, in other embodiments, the returning member 60 can be a torsion spring, a compression spring or other type of elastic member, but the connecting method of the returning member 60 with the swinging member 40 and the sliding base 30 should be modified correspondingly, and the swinging member 40 is able to return to the inward position I.

Figure 6:
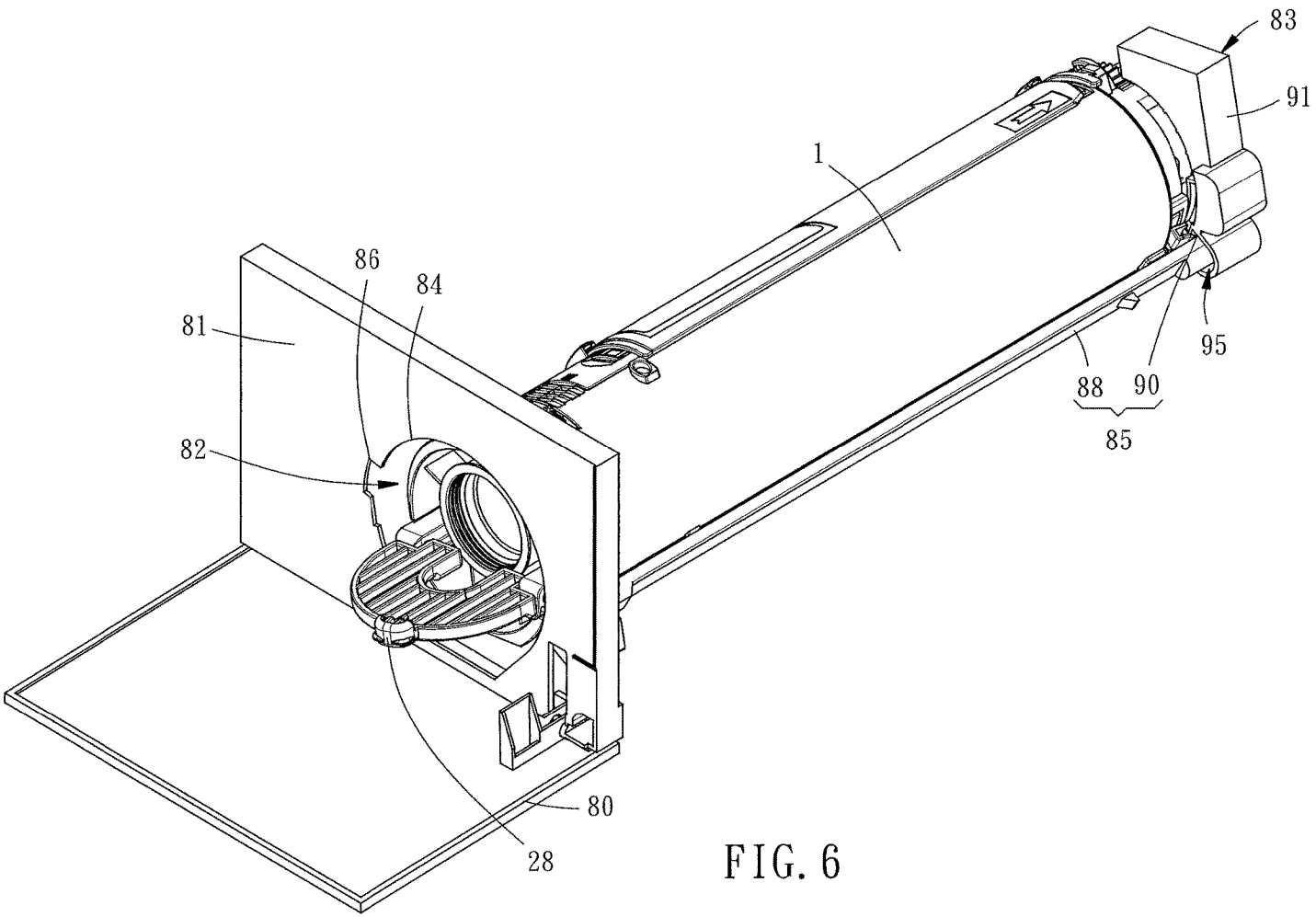
FIG. 6 is a perspective view of the toner cartridge and a part of an electronic image forming apparatus according to the preferred embodiment of the present invention.
Figure 7:
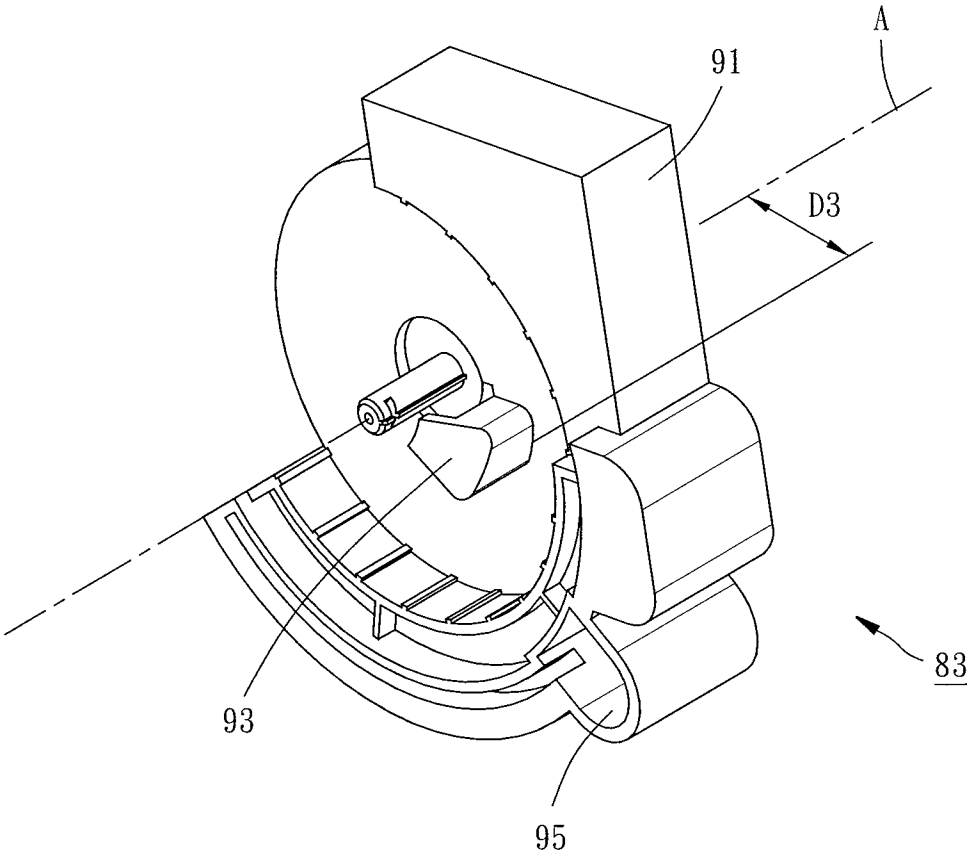
FIG. 7 is a perspective view of side cover of the electronic image forming apparatus.
Figure 8:
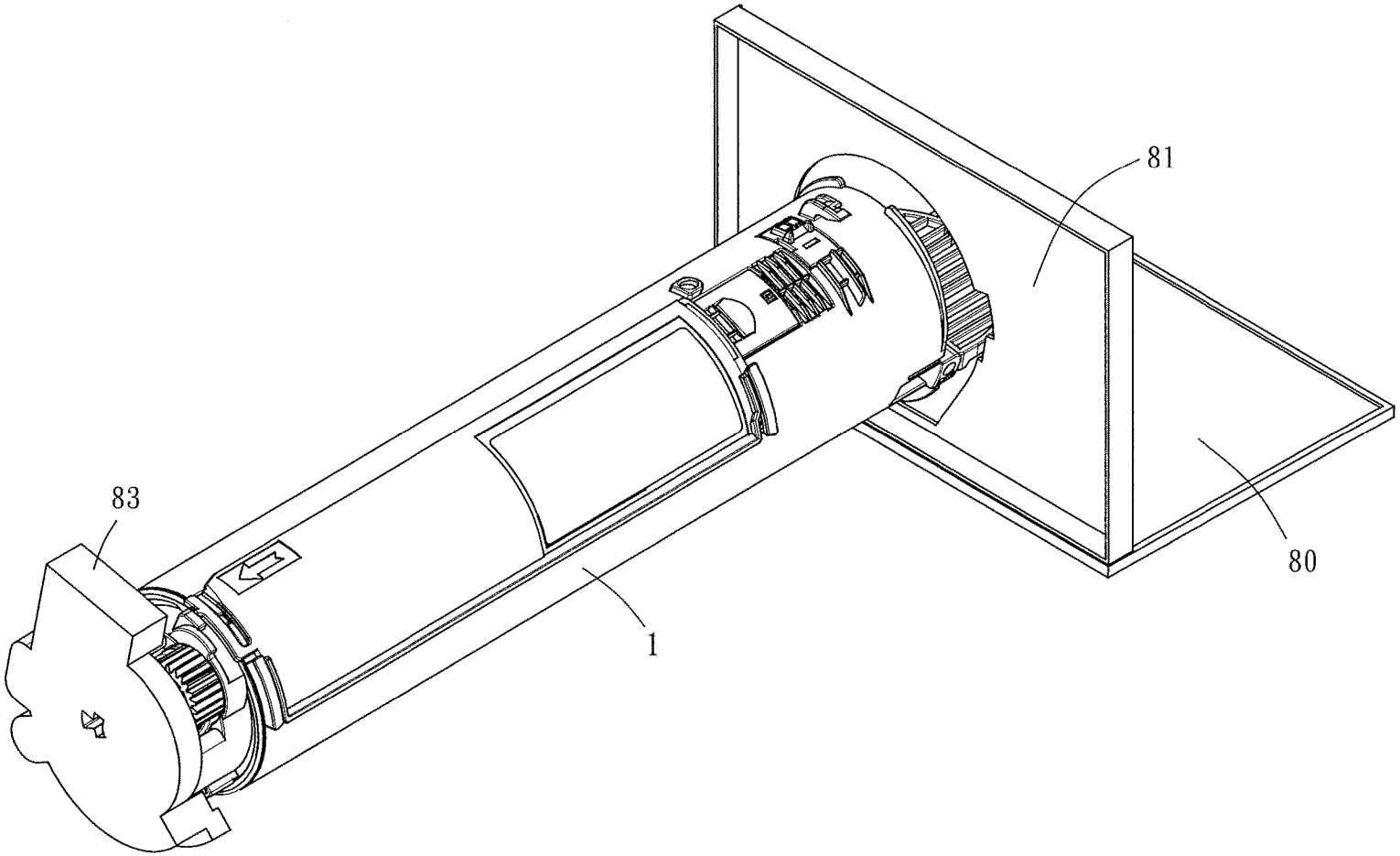
FIG. 8 is another perspective view of the toner cartridge and a part of the electronic image forming apparatus according to the preferred embodiment of the present invention.

Referring to FIGS. 6, 8 and 10, the toner cartridge 1 can be disposed in an electronic image forming apparatus 80 (such as a printer). In the following, a side toward the upper right of FIG.6 is defined as an inner side of the electronic image forming apparatus 80, and the other side toward the lower left of FIG. 6 is defined as an outer side of the electronic image forming apparatus 80. The electronic image forming apparatus 80 includes a shell body 81 provided with an accommodating space 82 in which the toner cartridge 1 is accommodated, a side cover 83 disposed at a side of the shell body 81 and located at an inner end 82*a* of the accommodating space 82, a door connecting rod 85 movably disposed at a lateral side of the accommodating space 82, a spring 87 provided with two ends abutted against the side cover 83 and the door connecting rod 85 (as shown in FIG. 10), and an inlet cover 89 movably disposed at another lateral side of the accommodating space 82. The shell body 81 provides with a assembling opening 84 communicated with accommodating space 82, and an opening edge of the assembling opening 84 provides with a positioning notch 86 into which the positioning block 28 inserts. Referring to FIG. 7, the side cover 83 includes a cover body 91, a protruded block 97 disposed at the cover body 91 and abuttable against the inner end portion 43 of the swinging member 40, and an end chamber 95 located at a location extending inwardly from the door connecting rod 85. The side cover 83 has a central axis A, the central axis A is located at a third distance D3 away from an outer periphery of the protruded block 93. When the swinging member 40 is located at the inward position I, the inner end portion 43 is located at a fourth distance D4 away from the imaginary axis L, and the third and fourth distances D3, D4 satisfy an inequality of D3>D4 (as shown in FIG. 10). Referring to FIG. 10, the door connecting rod 85 includes a rod body 88, and an abutted portion 90 disposed at the rod body 88 and abuttable against the outer end portion 45 of the swinging member 40. When the door connecting rod 85 is located at a lock position B, the moving of the inlet cover 89 is limited by the door connecting rod 85. Referring to FIG. 12, when the door connecting rod 85 is located at a release position C, the inlet cover 89 is movable. The spring 87 is accommodated in the end chamber 95 and applies a force on the door connecting rod 85 toward the lower side of FIG. 12. When the door connecting rod 85 is applied by other external force toward the upper side of the figure, the spring 87 is compressed (as shown in FIG. 12).

Referring to FIGS. 4 and 10, before the toner cartridge 1 is assembled into the electronic image forming apparatus 80, the swinging member 40 is applied by a force from the returning member 60 and located at the inward position I. Referring to FIGS. 6 and 8, when a user starts to assemble the toner cartridge 1 into the electronic image forming apparatus 80, the swinging member 40 should face toward the door connecting rod 85, and the toner cartridge 1 can be assembled into the electronic image forming apparatus 80 along the door connecting rod 85.

Figure 11:
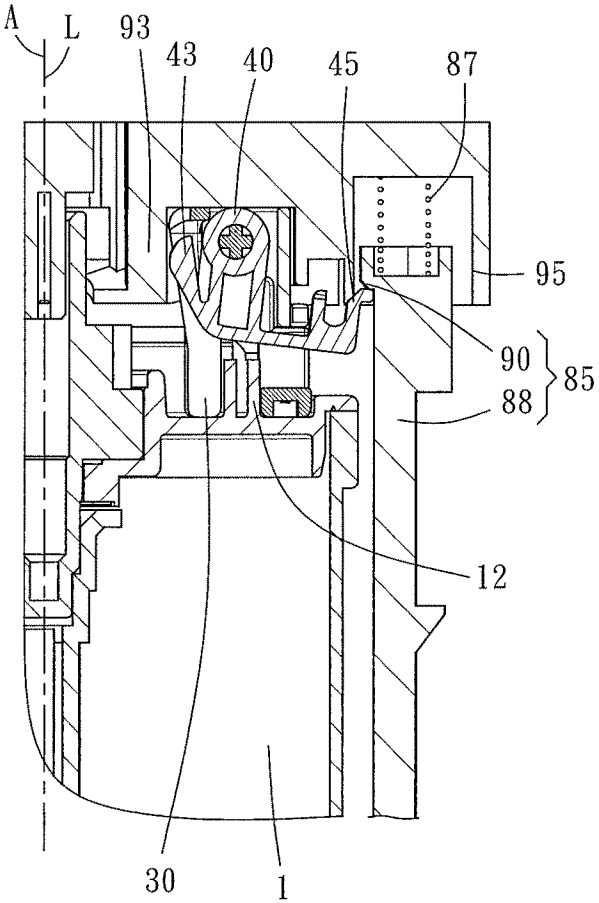

Referring to FIG. 11, the toner cartridge 1 is assembled into the electronic image forming apparatus 80 toward the top of the figure, the central axis A is overlapped with the imaginary axis L, the inner end portion 43 of the swinging member 40 is abutted against the protruded block 93, so that the swinging member 40 at the inward position I would swing toward the outward position O, the outer end portion 45 would push the abutted portion 90 of the door connecting rod 85, and the door connecting rod 85 would insert into the end chamber 95 with the outer end portion 45. Referring to FIGS. 6 and 11, rotate the toner cartridge 1 in a counter-clockwise direction of the FIG. 6, the outer end portion 45 is limited by a lateral wall of the end chamber 95, so that the sliding base 30 and the swinging member 40 would not rotate with the tubular portion 11, it means the sliding base 30 slides with the swinging member 40 relative to the rail 17. When the first inclinedly guiding section 20*c* abuts against the first abutting portion 47 and the second inclinedly guiding section 12*c* abuts against the second abutting portion 49, the swinging member 40 further swings toward the outward position O. When the toner cartridge 1 accommodated in the accommodating space 82 rotates exceeding a predetermined angle (such as 5 to 10 degree angle), the swinging member 40 is moved into the first and second protruded sections 20*a*, 12*a*, and moved by the rail 17 to the outward position O, so that the door connecting rod 85 is pushed by the outer end portion 45 to further insert into the end chamber 95 and be located at the release position C (as shown in FIG. 12). In addition, the outlet cover 23 is limited by the electronic image forming apparatus 80 and does not rotate with the tubular portion 11, so that the outlet cover 23 is moved away and does not cover the toner outlet 21 after the tubular potion 11 rotates (as shown in FIG. 16), and the inlet cover 89 not limited by the door connecting rod 85 would be pushed by the rotated toner cartridge 1 and move away from an toner inlet (not shown) of the electronic image forming apparatus 80. The toner cartridge 1 can be further rotated until the sliding base 30 is blocked by the limiting ring 14 and does not move anymore (as shown in FIGS. 13 and 14). At this time, the positioning block 28 of the handle 19 moves to a location where the positioning notch 86 is located and is insertable into the positioning notch 86 (as shown in FIG. 15), the toner outlet 21 is located corresponding to the toner inlet, and the positioning of the toner cartridge 1 is completed.

Figure 15:
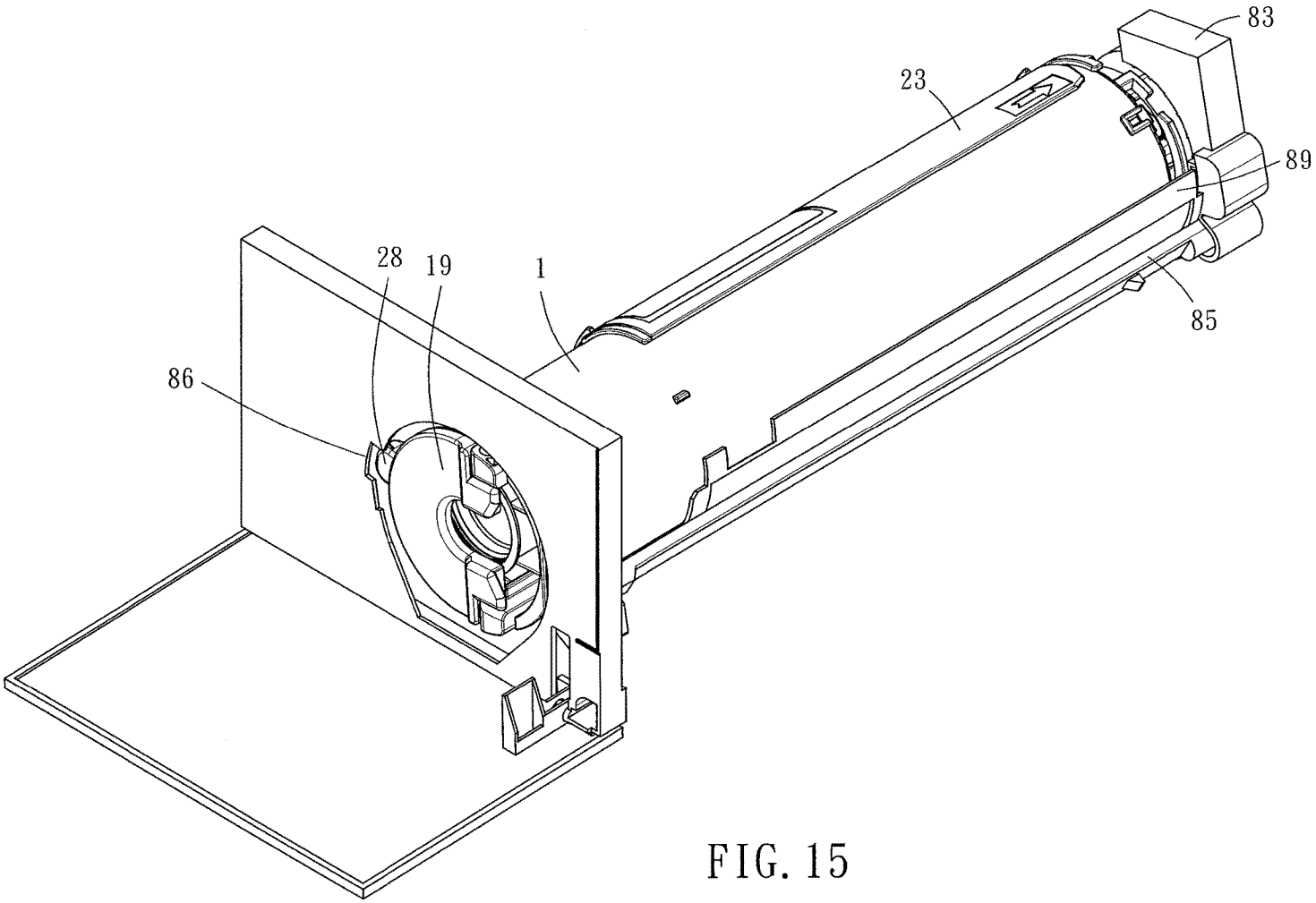
FIG. 15 is a perspective view of the toner cartridge and a part of the electronic image forming apparatus according to the preferred embodiment of the present invention.

Accordingly, in the process that a user assembles the toner cartridge 1 into the electronic image forming apparatus 80 and rotate the toner cartridge 1, the swinging member 40 is swung by the rail 17 and the protruded block 93 to the outward position O, and the swinging member 40 inserts into the end chamber 95 and would not rotate with the tubular portion 11, so that the swinging member 40 can keeps applying a force on the door connecting rod 85, to release a limitation of moving of the inlet cover 89, and the user can rotate the toner cartridge 1 to a position as shown in FIG. 15 easily only once.

On the other hand, if the user wants to take out the toner cartridge 1 from the electronic image forming apparatus 80, referring to the FIG. 15, rotate the toner cartridge 1 in a clockwise direction of the figure. When the swinging member 40 moves to the first and second inclinedly guiding sections 20*c*, 12*c*, the returning member 60 applies a force on the swinging member 40 (the spring 87 also applies a force on the door connecting rod 85 to push the swinging member 40), so that the swinging member 40 swings toward the inward position I until the swinging member 40 moves to the first and second hollow sections 20*b*, 12*b* (as shown in FIGS. 9 and 11). Referring to FIG. 6, the toner cartridge 1 can move away from the accommodating space 82 along the lower left of the figure. Referring to FIG. 10, when the swinging member 40 moves away from the door connecting rod 85, the door connecting rod 85 is moved to the lock position B by the spring 87, so that the moving of the positioned inlet cover 89 is limited, to block the toner inlet actually. Accordingly, a user can rotate the toner cartridge 1 from a position as shown in FIG. 15 to a position as shown in FIG. 6 directly and then take out the toner cartridge 1, the operation is very simple and easy, and the electronic image forming apparatus 80 can actually return back to a state that the toner cartridge 1 is not assembled.

It should be noticed that, on the basis of the present invention, the structure of the toner cartridge 1 can be modified. For example, the first abutting portion 47 and the radially protruded fringe 20, the second abutting portion 49 and the axial protruded rib 12 are respectively used for enabling the swinging member 40 to be located at the inward position I or the outward position O actually. However, in other embodiment, it can chose one of the first abutting portion 47 with the radially protruded fringe 20 or the second abutting portion 49 with the axial protruded rib 12 to dispose on the toner cartridge 1. The shape of the swinging member 40 can be modified, so that the swinging member 40 may be swung by the protruded block 93 to the outward position O directly, and the first abutting portion 47, the radially protruded fringe 20, the second abutting portion 49 and the axial protruded rib 12 can be omitted. The first and second inclinedly guiding sections 20*c*, 12*c* are respectively used for enabling the swinging member 40 to move between the first protruded section 20*a* and the first hollow section 20*b* and between the second protruded section 12*a* and the second hollow section 12*b* with smoothness, however, it can chose one of the first and second inclinedly guiding section 20*c*, 12*c* to dispose on the toner cartridge 1 or both of which can be omitted. The structure for sliding along the rail 17 is not limited to the sliding notch 32 and the axial protruded rib 12, any type of rail designs can be applied. The bridge portion 18 is used for disposing the radially protruded fringe 20, however, there may be other structure for fixing the radially protruded fringe 20 thereon. The shape of the handle 19 may be modified, any structure which is convenient for user's operation can be applied. In this embodiment, a distance between the sliding base 30 and the imaginary axis L is fixed because of the arc-shaped axial protruded rib 12, however, in other embodiments, the shape of the axial protruded rib 12 can be modified, and the distance between the sliding base 30 and the imaginary axis L can be modified, so long as the swinging member 40 can swing to the outward position O (abut against the door connecting rod 85).

The above description represents merely the preferred embodiment of the present invention, without any intention to limit the scope of the present invention. The simple variations and modifications not to be regarded as a departure from the spirit of the invention are intended to be included within the scope of the following claims.

What is claimed is:

1. A toner cartridge, comprising:

a tubular body, comprising an arc-shape rail at a first end thereof, and a geometric center through which an imaginary axis passes;

a sliding base, disposed on the rail and slidable along the rail;

a swinging member, comprising a pivotal portion pivotally connected with the sliding base, an inner end portion that is nearer to the imaginary axis than the pivotal portion is, and an outer end portion that is farther from the imaginary axis than the pivotal portion is; the swinging member being swingable between an inward position and an outward position relative to the sliding base; and a returning member, connected with the swinging member and applying a force returning the swinging member to the inward position.

2. The toner cartridge as claimed in claim 1, wherein the swinging member further comprises a first abutting portion located between the pivotal portion and the outer end portion; the rail of the tubular body has a radially protruded fringe against which the first abutting portion abuts, the radially protruded fringe comprises a first protruded section and a first hollow section located at an end of the first protruded section; when the first abutting portion abuts against the first hollow section, the swinging member is located at the inward position; when the first abutting portion abuts against the first protruded section, the swinging member is located at the outward position.

3. The toner cartridge as claimed in claim 2, wherein the radially protruded fringe of the rail further comprises a first inclinedly guiding section located between the first hollow section and the first protruded section.

4. The toner cartridge as claimed in claim 2, wherein the sliding base comprises a sliding notch, and the rail of the tubular body comprises an axial protruded rib inserting into the sliding notch.

5. The toner cartridge as claimed in claim 4, wherein the swinging member comprises a second abutting portion located between the pivotal portion and the first abutting portion and inserting into the sliding notch; the axial protruded rib is abuttable against the second abutting portion; the axial protruded rib comprises a second protruded section and a second hollow section located at an end of the second protruded section; when the second abutting section abuts against the second hollow section, the swinging member is located at the inward position; when the second abutting portion abuts against the second protruded section, the swinging member is located at the outward position.

6. The toner cartridge as claimed in claim 5, wherein the axial protruded rib further comprises a second inclinedly guiding section located between the second hollow section and the second protruded section.

7. The toner cartridge as claimed in claim 4, wherein the rail further comprises a bridge portion located at a position corresponding to the axial protruded rib; the radially protruded fringe is disposed at the bridge portion; a gap exists between the bridge portion and the axial protruded rib for pass of the swinging member therethrough.

8. The toner cartridge as claimed in claim 7, wherein the rail of the tubular body comprises the axial protruded rib extending from the first end of the tubular body, and a limiting ring disposed at the first end of the tubular body; the limiting ring has the bridge portion and the radially protruded fringe.

9. The toner cartridge as claimed in claim 1, wherein the returning member is an extension spring.

10. The toner cartridge as claimed in claim 1, further comprising a handle, the handle having two pivotal portions pivotally connected with a second end of the tubular body, and a positioning block disposed at an outer periphery of the handle; distances from the positioning block to the two pivotal portions are not equal.

11. The toner cartridge as claimed in claim 1, adapted for being disposed in an electronic image forming apparatus, the electronic image forming apparatus comprising an accommodating space in which the toner cartridge is accommodated, a protruded block disposed at an inner end of the accommodating space and abuttable against the inner end portion of the swinging member, a door connecting rod disposed at a lateral side of the accommodating space, and an end chamber located at a location extending inwardly from the door connecting rod; the door connecting rod having an abutted portion; when the toner cartridge is accommodated in the accommodating space, the swinging member located at the inward position is abutted against the protruded block and swings toward the outward position, so that the outer end portion abuts against the abutted portion of the door connecting rod and the door connecting rod inserts into the end chamber with the outer end portion; when the toner cartridge accommodated in the accommodating space rotates exceeding a predetermined angle, the swinging member is moved by the rail to the outward position where the door connecting rod further inserts into the end chamber.

12. The toner cartridge as claimed in claim 1, wherein the sliding base comprises a sliding notch, and the rail of the tubular body comprises an axial protruded rib inserting into the sliding notch.

13. The toner cartridge as claimed in claim 12, wherein the swinging member comprises a second abutting portion located between the pivotal portion and the outer end portion and inserting into the sliding notch; the axial protruded rib is abuttable against the second abutting portion; the axial protruded rib comprises a second protruded section and a second hollow section located at an end of the second protruded section; when the second abutting section abuts against the second hollow section, the swinging member is located at the inward position; when the second abutting portion abuts against the second protruded section, the swinging member is located at the outward position.

14. The toner cartridge as claimed in claim 13, wherein the axial protruded rib further comprises a second inclinedly guiding section located between the second hollow section and the second protruded section.

15. The toner cartridge as claimed in claim 1, wherein the sliding base keeps a fixed distance from the imaginary axis during sliding along the rail.

16. The toner cartridge as claimed in claim 1, when the swinging member is located at the inward position, the outer end portion is located at a first distance D1 away from the imaginary axis; when the swing member is located at the outward position, the outer end portion is located at a second distance D2 away from the imaginary axis, the first and second distances D1 and D2 satisfy an inequality of D1<D2.

17. The toner cartridge as claimed in claim 1, wherein the returning member is connected with the sliding base.

* * * * *